US005122004A

United States Patent [19]

Yamada et al.

[11] Patent Number: 5,122,004

[45] Date of Patent: Jun. 16, 1992

[54] PRINTING SYSTEM WITH A FUNCTION OF PRINTING ON LABELS

[75] Inventors: Fumihiro Yamada, Ama; Mitsumasa Kako, Tokai, all of Japan

[73] Assignee: Brother Kogyo Kabushiki Kaisha, Nagoya, Japan

[21] Appl. No.: 650,241

[22] Filed: Feb. 4, 1991

[30] Foreign Application Priority Data

May 17, 1990 [JP] Japan ..... 2-127385

[51] Int. Cl.[5] ..... B41J 11/34

[52] U.S. Cl. ..... 400/616.2; 400/616; 226/189

[58] Field of Search ..... 101/288, 291, 292, 52, 101/53; 226/189; 400/616, 616.1, 616.2, 533, 543

[56] References Cited

U.S. PATENT DOCUMENTS

| | | | |
|---|---|---|---|
| 1,826,903 | 10/1931 | Smith | 400/533 |
| 4,386,860 | 6/1983 | Price | 400/124 |
| 4,516,208 | 5/1985 | Sakura | 364/466 |
| 4,948,282 | 8/1990 | Koike | 400/616.2 |
| 5,040,461 | 8/1991 | Van-Ocker | 101/288 |

FOREIGN PATENT DOCUMENTS

| | | | |
|---|---|---|---|
| 191493 | 8/1986 | European Pat. Off. | 101/288 |
| 94365 | 4/1987 | Japan | 400/616 |
| 2194488 | 3/1988 | United Kingdom . | |

*Primary Examiner*—Edgar S. Burr
*Assistant Examiner*—Eric Raciti
*Attorney, Agent, or Firm*—Oliff & Berridge

[57] ABSTRACT

A label separating system for separating labels from a backing web after the labels have been printed is disclosed. This system utilizes the paper holding roller which is used for holding paper against the platen as it is printed and a separating roller upstream from the paper holding roller. A tractor feed upstream of the separating roller draws the backing web from the platen over the separating roller. A holding member is positioned to limit movement of the paper holding roller as the backing web is placed under tension by the tractor feed, thereby insuring that the backing web disposed between the platen and the separating roller is urged toward a line connecting the center of the platen and the center of the separating roller. This insures that the backing web is bent to a sufficient degree as it passes over the separating roller to cause separation of the label. The holding member for holding the paper holding roller can be mounted on a pivoted lever that also serves as a part of a detachable mounting system for mounting the label separator on the printer. A guide roller is positioned adjacent and parallel to the separating roller and, with the separating roller, defines an S-shaped path for the backing web which further insures separation of the label from the backing web.

20 Claims, 5 Drawing Sheets

PRINTING SYSTEM WITH A FUNCTION OF PRINTING ON LABELS

BACKGROUND OF THE INVENTION

1. Field of the Invention

This invention relates to a printing system having a function of printing not only on ordinary sheets such as web sheet or cut sheets, but also on labels removably adhered to a backing web.

2. Description of Related Art

A typical printing system for printing on labels is disclosed, for example, in British unexamined patent publication No. 2,194,488A laid open of Mar. 9, 1988.

In such a printing system, a separating roller which bends and guides a backing wet contacting with a side on which labels are not adhered is arranged in a downstream side of a platen in a paper feeding direction, and a paper holding roller is arranged between the platen and the separating roller.

The paper holding roller is biased toward the outer periphery of the platen and moves between a holding position contacting with the outer periphery of the platen and releasing position separating therefrom by a predetermined distance.

The backing web with labels extends to a pull tractor through the platen, the paper holding roller, and the separating roller, and the labels adhered on the backing web are printed on the platen. The backing web with printed labels is fed in the feeding direction by the tractor. In this moment, the tension force in the feeding direction of the backing web acts on the backing web with the printed labels. The paper holding roller is moved in a direction away from the platen by the tension force resulting from the above feeding movement, against its normal bias in the direction of the platen.

Further, the position of the paper holding roller is not fixed because the tension force which acts on the backing web changes according to the change of the feeding speed of the backing web. Specifically, the paper holding roller moves to a tangent common to the platen and the separating roller when the feeding speed of the backing web becomes fast and the tension which acts on the backing web becomes great.

In the printing system of the construction described above, the label is not always separated from the backing web by the separating roller, and is fed with the backing web being curved along the separating roller.

SUMMARY OF THE INVENTION

Accordingly, it is an object of the present invention to overcome the above problems and to provide a print system which can prevent a label from not separating from a backing web.

The object is attained by providing a print system for printing not only on ordinary papers, such as web sheet or cut sheet, but also on labels removably adhered to a backing web on a same platen comprising: a separating roller which is arranged in the downstream side of a platen in a paper feeding direction, and which curves and guides a backing web with labels contacting with a side on which labels are not adhered, a paper holding roller which is arranged between the platen and the separating roller and is urged toward the outer periphery of the platen, and which moves between a holding position contacting with an outer periphery of the platen and a releasing position separated therefrom by a predetermined distance, and holding means for holding the paper holding roller in an operating position wherein the portion of the backing web with the labels which extends between the platen and the separating roller is curved in the direction of a line passing through the center of the platen and the center of the separating roller.

In the print system thus constructed, when the label adhered on the backing web is printed on the platen and the backing web with printed label is fed, the paper holding roller is moved by the tension which acts on the backing web in the direction of the releasing position, separated from the platen by a predetermined distance. At this time, the paper holding roller is held in the operating position, which is located between the holding position and the releasing position, by the holding means. And, the backing web with the labels extending between the platen and the separating roller is pressed by the paper holding roller held in the operating position, and is curved in the direction of the line passing through the center of the platen and the center of the separating roller.

When the backing web is pressed in the direction to the line passing through the center of the platen and the center of the separating roller and is turned along the outer periphery of the separating roller, the force for peeling the label from the backing web is strong because of the elastic force of the label. As a result, the label is peeled reliably from the backing web.

As mentioned above, according to the present invention, it is possible to hold the paper holding roller by the holding means in the operating position, which is located between the holding position, contacting with the outer side of the platen, and the releasing position, separated from the platen by a predetermined distance. Therefore, the backing web with the labels extending between the platen and the separating roller is turned along the outer side of the separating roller, curving in the direction toward the line connecting the center of the platen and the center of the separating roller, by the paper holding roller. And the force for peeling the labels from the backing web becomes strong because of the elastic force of the label. As a result, the labels are peeled reliably from the backing web. The labels are prevented from curving with the backing web along the separating roller, without peeling from the backing web.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Figure 2:
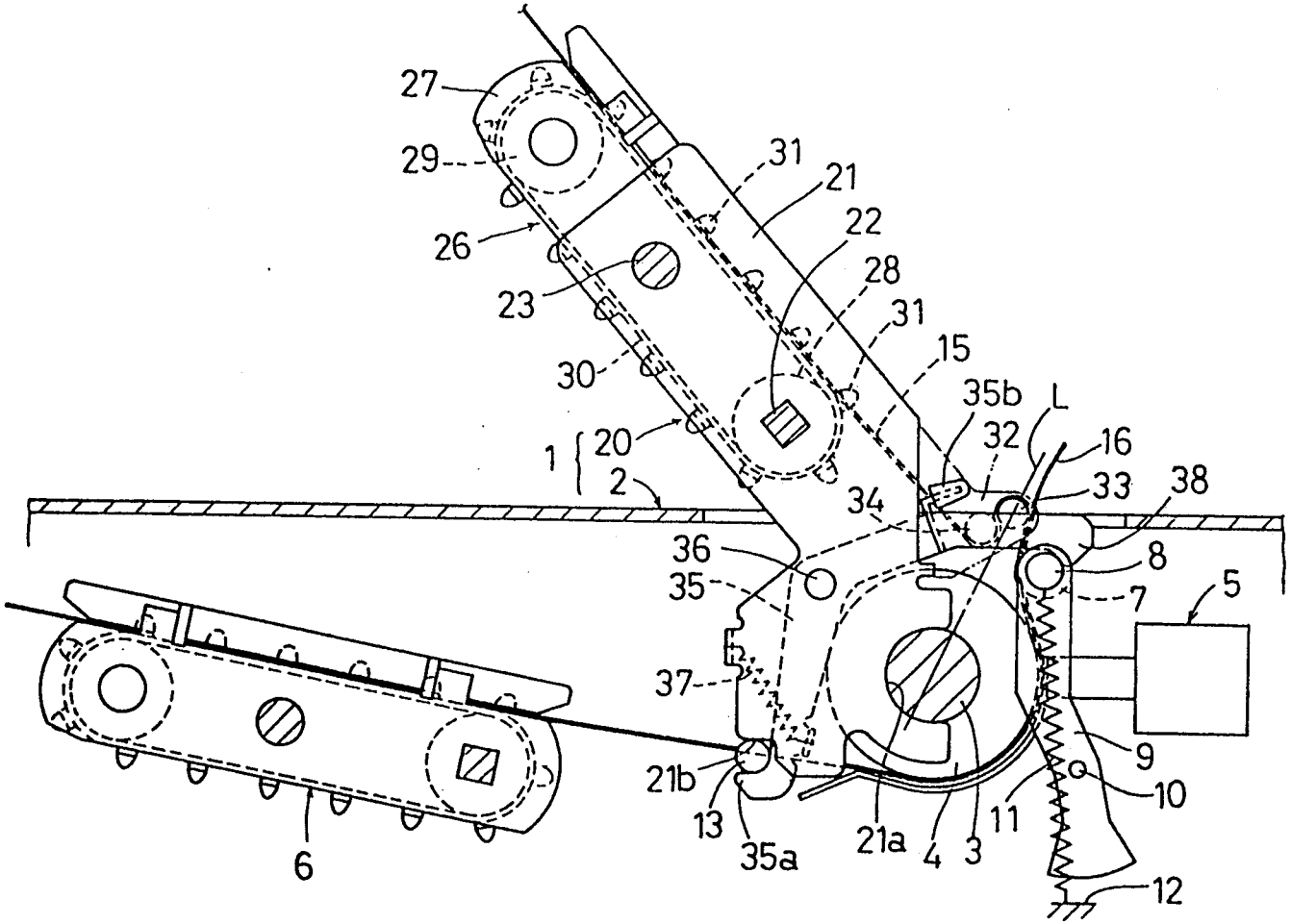
FIG. 2 is a vertical sectional side elevational view showing a feeding passage for print paper (a backing web with labels) of the printing system.

A detailed description of one preferred embodiment of a printer embodying the present invention will now be given referring to the accompanying drawings. As shown in FIG. 2, a printing system 1 includes a system body 2 and a label separating unit 20 which is removably mounted on the system body 2.

The system body 2 includes a platen 4 supported by a platen shaft 3, a print head 5, which is disposed in spaced, opposing relationship to the platen 4 to define a space for passage of a sheet between the platen 4 and which moves leftwardly and rightwardly along the platen 4, and a push tractor 6 for feeding print paper, such as a backing web 15, to the platen 4.

A roller arm 9 supporting on the upper portion thereof a roller shaft 8 having a paper holding roller 7 is pivotably mounted for pivoting about an axis 10.

Figure 4:
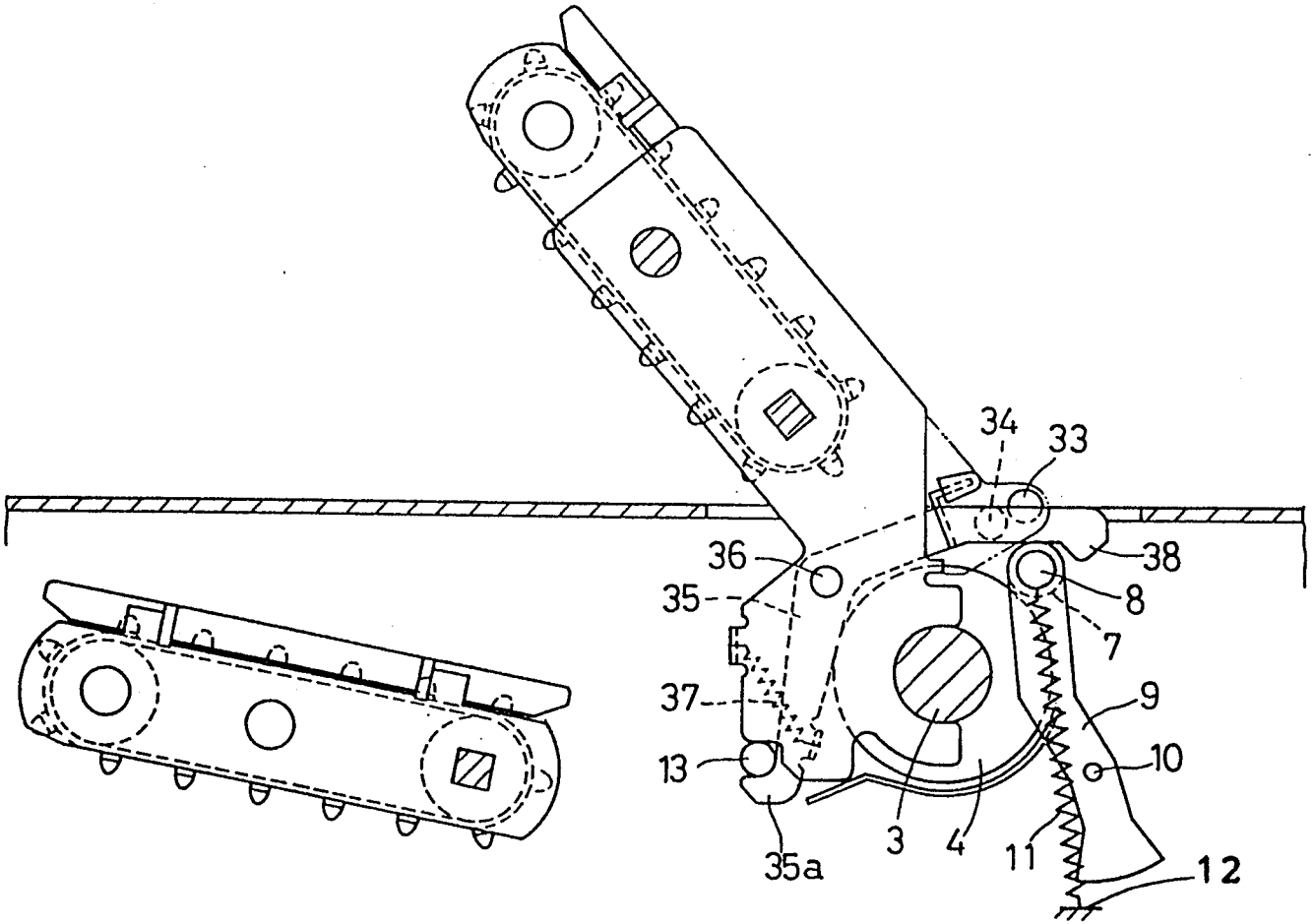
FIG. 4 is a sectional side view of the label separating device when a paper holding roller is in a holding position.
Figure 5:
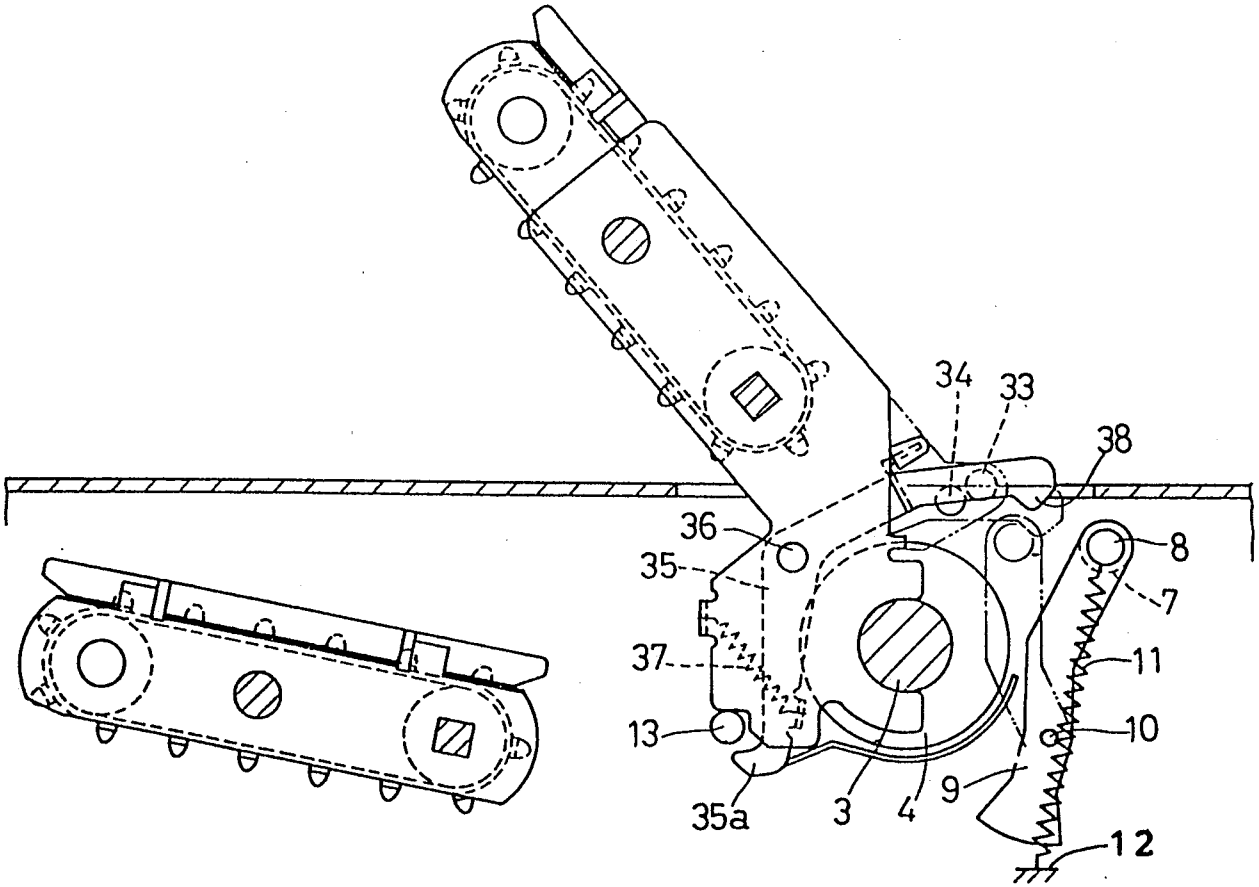
FIG. 5 is a sectional side view of the label separating device when the paper holding roller is in a releasing position.

The paper holding roller 7 of the roller arm 9 is arranged between the platen 4 and a separating roller to be described later. The paper holding roller 7 is rotated on the axis 10 between a holding position contacting with the outer periphery of the platen 4, as shown in FIG. 4, and a releasing position separated from the outer periphery of the platen 4 by a predetermined distance as shown in FIG. 5. The paper holding roller 7 is held in the holding position and the releasing position by a spring The spring 11 is provided between the roller shaft 8 supported on the upper portion of the roller arm 10 and a spring hook portion 12 formed on a predetermined position of the frame of the system body 2.

Figure 3:
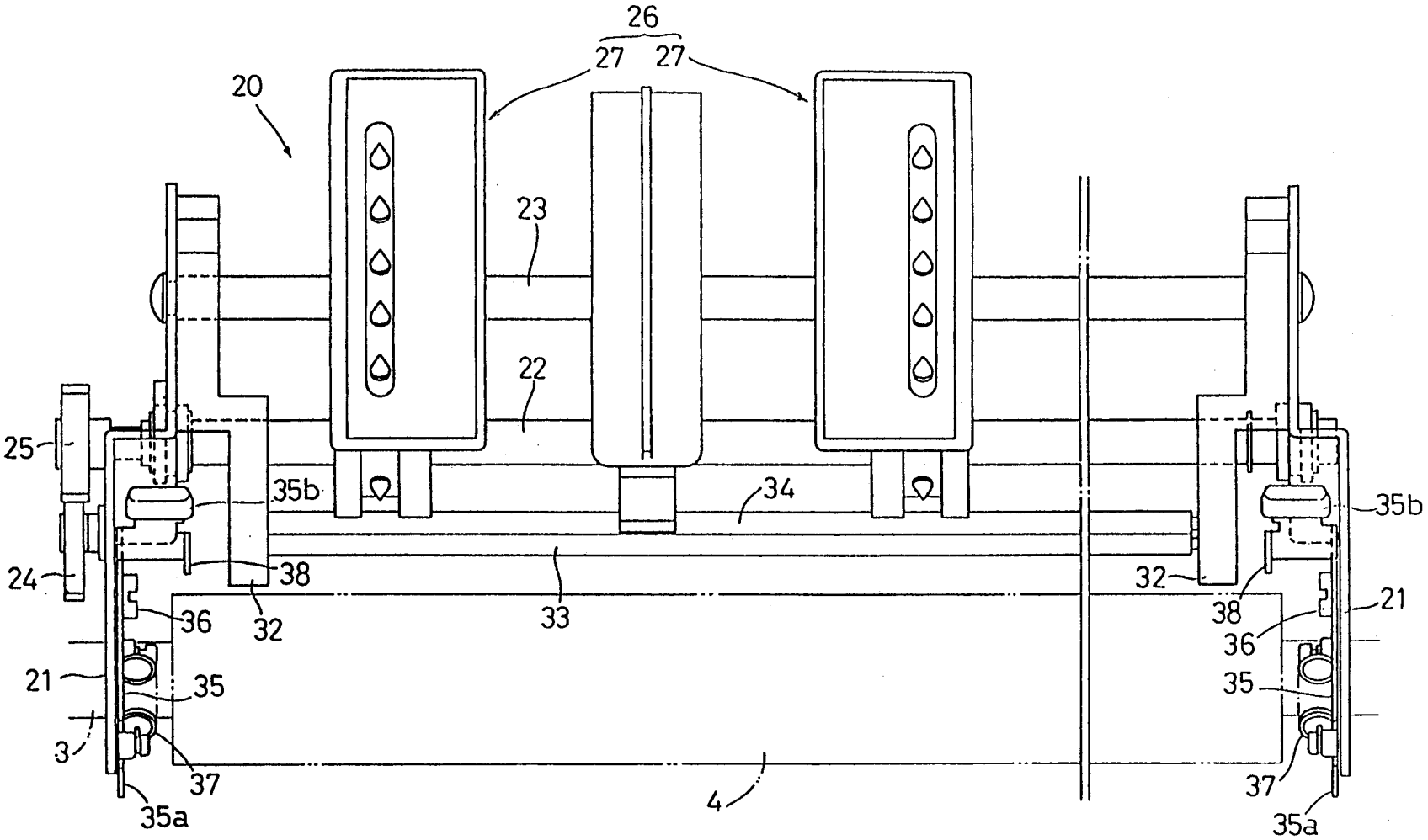
FIG. 3 is a elevational view showing the label separating device of the printing system.

The label separating unit 20 is mounted removably on the system body 2 and on the downstream side of the platen 4, in the paper feeding direction. As shown in FIG. 2 and FIG. 3, a drive shaft 22 and a guide shaft 23 are supported in parallel on a pair of left and right unit frames 21 of the label separating unit 20. A tractor drive gear 25 which is removably engaged with an operation gear (not shown) provided in the system body 2 through an intermediate gear 24 is provided at one end of the drive shaft 22 (at a left end portion in FIG. 3). A pair of tractors 27, which constitutes a pull tractor 26, are supported slidably on the drive shaft 22 and the guide shaft 23 and are adjusted according to the width of the sheet being printed. Each tractor 27 includes a pair of tractor belts 30 extending between drive pulleys 28 fitted on the drive shaft 22 and corresponding follower pulleys 29 disposed behind the drive pulleys 28. Engaging projections 31 are provided on the outer peripheries of the tractor belts 30 and are adapted to be engaged in the sprocket holes 17 of the backing web 15 to feed the backing web 15 when the tractor belts 30 are turned by the drive pulleys 28. The drive pulley 28 is fitted on the drive shaft 22 to be rotated by the drive shaft 22 and is slidably along the drive shaft 22.

A pair of brackets 32 are provided between the pair of left and right unit frames 21. A separating roller 33 and a guide roller 34 are supported on the brackets 32, between the platen 4 and the tractor 26. Rollers 33 and 34 extend in parallel to the platen 4.

Subsequently, description is given of a structure in which the label separating unit 20 is removably supported on the system body 2. At the lower portion of each unit frame 21 thus constructed, as shown in FIG. 2, a semicircular fitting recess 21*a*, which is removably engaged with the outer periphery of platen shaft 3 and a engaging portion 21*b*, which is engaged with a engaging pin 3 installed on a frame of the system body 2 (not shown), are formed.

Each of the unit frames 21 has engaging levers 35 mounted for pivotal motion on an inner side thereof by means of pins 36. Each engaging lever 35 has a knob portion 35*b* formed at an upper portion thereof while a hook portion 35*a* is formed in a rearward direction at a lower end of the engaging lever 35. The engaging levers 35 are disposed such that the hook portions 35*a* thereof may be engaged with engaging pins 13 provided on the opposite side portions of the system body 2.

Each engaging lever 35 is urged in a position that the hook portion 35*a* is engaged with the engaging pin 13 by a tension spring 37. The fitting recesses 21*a* of two unit frames 21 are fitted onto the platen shaft 3 and the hook portions 35*a* of the engaging levers 35 and the engaging portions 21*b* of the unit frames 21 are engaged with the engaging pins 13, so that the label separating unit 20 is installed on the system body 2. The engaging levers 35 are pivoted by the knob portions 35*b* against the urging force of the tension springs 37 and the hook portions 35*a* of the engaging levers 35 are removed from the engaging pins 13, so that the label separating unit 20 can be removed from the system body 2.

Figure 1:
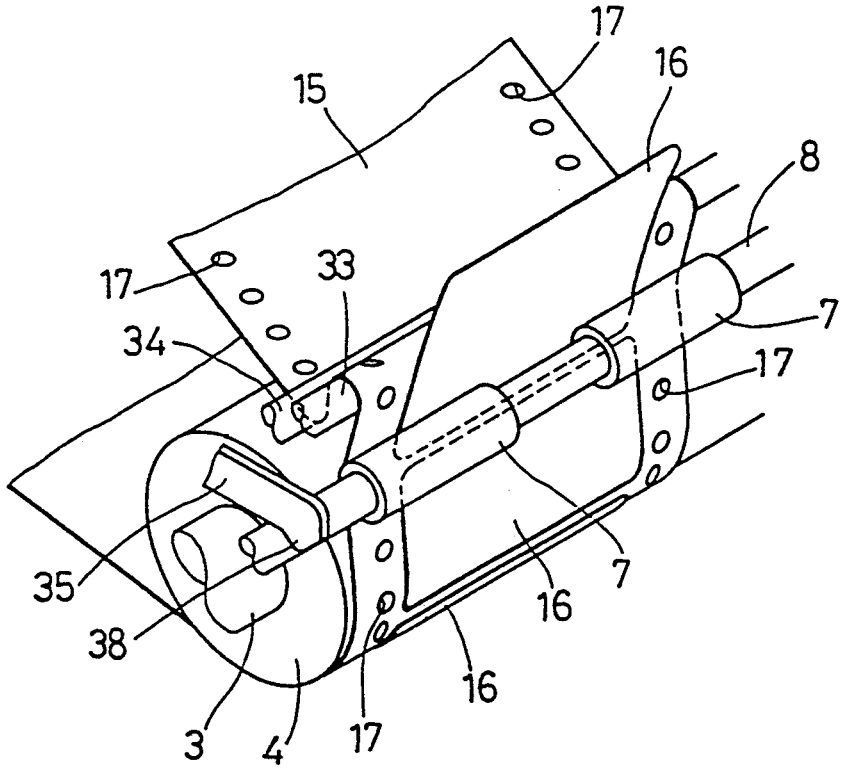
FIG. 1 is a perspective view showing a label separating device of a printing system of the present invention.

As shown in FIG. 1 and FIG. 2, each engaging lever 35 has a holding portion 38 formed at an upper end thereof and at a position spaced from the roller shaft 8 of the paper holding roller 7, when the roller 7 is engaging the periphery of the platen. The engaging levers 35 are disposed such that the holding portion 38 thereof may be engaged with the roller shaft 8 and may hold the paper holding roller 7 in the operating position.

As shown in FIG. 2, when the label 16 adhered on the backing web 15 is printed by the print head 5 on the platen 4 and the backing web 15 with printed label 16 is pulled by the pull tractor, the paper holding roller 7 is moved in a direction away from the platen 4 by the tension force which acts on the backing web 15. At this time, the holding portion 38 engages with the roller shaft 8 so that the paper holding roller 7 is prevented from moving further away from the platen 4 and is held in the operating position. The part of the backing web 15 extending between the platen 4 and the separating roller 33 is pressed by the paper holding roller 7, which is in the operating position, and the web 15 is curved by a predetermined distance in the direction of a line L which passes through the center of the platen 4 and the center of the separating roller 33.

Usually, many labels 16 are removably adhered on the backing web 15 in a longitudinal direction of the label adhering side in a fixed pitch. The sprocket holes 17 are arranged corresponding to the engaging projections 31 of the tractor belt 30 of the tractor 27 on both edges of the backing web 15.

Next, operation of the printing system of the above-described embodiment will be explained.

In order to print on the labels 16 adhered on the backing web 15, the backing web 15 is extended from the push tractor 6 to the pull tractor 26 over the platen 4, the separating roller 33, and the guide roller 34. At this time, the paper holding roller 7 is arranged in the releasing position as shown in FIG. 5.

After the backing web 15 with labels 16 is set, the paper holding roller 7 is moved from the releasing position to the holding position, passing the holding portion 38 of an engaging lever 35. At this time, the paper holding roller 7 is urged by the spring 11 to the holding position, so that the paper holding roller 7 presses the label-carrying side of the backing web 15, and the backing web 15 is curved in the direction of the center line L.

In this condition, when the label 16 adhered on the backing web 15 is printed by the print head 5 on the platen 4, the push tractor 6 and the pull tractor 26 are driven in synchronization with the rotation of the platen 4, and the backing web 15 moves in the feeding direction a predetermined distance. At this time, the paper holding roller 7 is moved in the direction of the releasing position against the urging force of the spring 11 by the tension force which acts on the backing web 15.

However, the roller shaft 8 of the paper holding roller 7 is engaged by the holding portion 38 of the engaging lever 35 and the movement of the roller shaft 8 is restricted, so that the paper holding roller 7 is held in the operating position. As a result, the part of the backing web 15 extending between the platen 4 and the separating roller 33 is pressed by the paper holding roller 7, which is in the operating position, and, as shown in FIG. 2, the part of the backing web 15 between platen 4 and separating roller 33 is curved in the direction of the center line L by a predetermined distance.

On the other hand, the part of the backing web 15 extended from the separating roller 33 to the guide roller 34 is curved along the outer peripheries of each roller and is fed by the pull tractor 26.

Therefore, as shown in FIG. 1 and FIG. 2, the label 16 adhered on the label-carrying side of the backing web 15 is peeled reliably from the backing web 15 by the separating roller 33.

In other words, the paper holding roller 7 is held in the operating position by the holding portion 38 of the engaging lever 35. The part of the backing web 15 extending between the platen 4 and the separating roller 33 is curved in the direction of the center line L by the paper holding roller 7, and is turned in a zigzag fashion along the outer peripheries of the separating roller 33 and guide roller 34. Therefore, the force for peeling the label 16 from the backing web 15 is developed from the elastic force of the label 16. As a result, the label 16 is peeled reliably from the backing web 15. This prevents the label 16 from feeding with the backing web 15 along the outer periphery of the separating roller 33 without peeling from the backing web 15.

Although the holding portion 38 for holding the paper holding roller 7 in the operating position was formed at the upper end of the engaging levers 35 in the above-mentioned embodiment, it is possible for the holding portion constituting the hold means to be separate from the engaging levers 35.

In the description of the preferred embodiment, the various web-engaging members for separating the label from the web have been described as rollers, for example, paper holding roller 7, separating roller 33, and guide roller 34. However, it should be realized that for purposes of the invention, one or more of these elements may be non-rotating members that have smooth web-engaging surfaces for allowing the web and adhered labels to be drawn over such surfaces, thereby effecting the desired label separation.

What is claimed is:

1. A print system for printing on labels removably adhered to a backing web, which backing web passes over an outer peripheral surface of a platen rotatable about an axis comprising:

a separating member which is arranged on the downstream side of the platen in a paper feeding direction, and which curves and guides the backing web by engaging a side thereof on which labels are not adhered, said separating member having a longitudinal axis substantially parallel to the axis of the platen;

a paper holding member arranged between the platen and the separating member; means for urging the paper holding member toward the outer periphery of the platen; and means mounting the paper holding member for movement between a holding position contacting with the outer periphery of the platen and a releasing position separated from the platen by a predetermined distance; and holding means for holding the paper holding member in an operating position at which the portion of the backing web extending between the platen and the separating roller is curved in a direction toward a line passing through the axis of rotation of the platen and the longitudinal axis of the separating member.

2. A print system according to claim 1, further comprising: feed means for feeding said backing web.

3. A print system according to claim 1, wherein the holding means comprises engaging means for limiting movement of the paper holding roller away from the platen.

4. A print system according to claim 3, wherein the holding means comprises a stop.

5. A print system as in claim 1, and further comprising a drive means upstream of the platen for drawing the backing web from the platen.

6. A print system as in claim 5, wherein the drive means is a tractor feed.

7. A print system as in claim 6, and further comprising a second feeding means for feeding the backing web to the platen.

8. A print system as in claim 7, wherein the second feeding means is a tractor feed.

9. A print system as in claim 1, and further comprising a guide member adjacent the separating member, said guide member being parallel to the separating member and defining with the separating member an S-shaped feed path for the backing web.

10. A label separation system for separating labels from a label-bearing backing web, which labels have been printed in a printer having a platen rotatable about an axis of rotation comprising:

a frame;

means for mounting the frame on the printer;

a separating member;

means mounting the separating member on the frame in substantially parallel relation to the platen;

drive means mounted on the frame for drawing the backing web from the platen; and a paper holding member positioned to engage a portion of the label bearing backing web disposed between the platen and the separating member, said paper holding member being movable between an operative position in engagement with the label-bearing web and an inoperative position spaced from the platen; and means for holding the paper holding member in said operative position so that the backing web is curved toward a line connecting the center of the separating member and the axis of rotation of the platen.

11. A label separation system as in claim 10, wherein the means for mounting the frame on the printer comprises means for detachably mounting the frame on the printer.

12. A label separation system as in claim 11, wherein the detachable mounting means includes the means for holding the paper holding member.

13. The label separation system as in claim 12, wherein the detachable mounting means includes a pivotally mounted lever and the means includes a pivotally mounted lever and the means for holding the paper holding member is mounted on the lever.

14. The label separation system as in claim 13, wherein the lever includes engaging means for engaging the frame.

15. The label separation system as in claim 14, and further comprising a spring for urging the lever to a position wherein the engaging means engages the frame and thereby positions the holding means to limit movement of the paper holding member.

16. The label separation system as in claim 10, wherein the paper holding member includes biasing means for biasing the paper holding member in a first position toward the platen, wherein said paper holding member is in said operative position, and for biasing the paper holding member in a second position wherein the paper holding member is in said inoperative position spaced from the platen.

17. The label separation system as in claim 16, wherein the biasing means is a tension spring fixed at one end to the frame.

18. The label separation system as in claim 17, and further comprising a guide member and means mounting the guide member adjacent and parallel to the separating member.

19. The label separation system as in claim 18, and further comprising drive means for drawing the backing web from the platen.

20. The label separation system as in claim 19, wherein the drive means is a tractor feed.

* * * * *